United States Patent [19]

Overbo

[11] Patent Number: 4,566,247

[45] **Date of Patent: * Jan. 28, 1986**

[54] CAPTIVE COLUMN

[76] Inventor: Gordon I. Overbo, 302 16th Ave. S., Devils Lake, N. Dak. 58301

[ * ] Notice: The portion of the term of this patent subsequent to Sep. 10, 2002 has been disclaimed.

[21] Appl. No.: 579,270

[22] Filed: Feb. 13, 1984

Related U.S. Application Data

[63] Continuation-in-part of Ser. No. 519,980, Aug. 3, 1983, Pat. No. 4,539,785.

[51] Int. Cl.[4] ..... E04C 3/10; E04C 3/30

[52] U.S. Cl. ..... 52/732; 52/222; 52/309.16; 52/730

[58] Field of Search ..... 52/222, 309.1, 309.7, 52/309.16, 637, 648, 653, 730, 732; 65/1

[56] References Cited

U.S. PATENT DOCUMENTS

| | | | |
|---|---|---|---|
| 2,516,020 | 7/1950 | Reed | 52/730 X |
| 3,111,569 | 11/1963 | Rubenstein | 52/DIG. 7 |
| 3,271,917 | 9/1966 | Rubenstein | 52/DIG. 7 |
| 3,501,880 | 3/1970 | Bosch | 52/222 |
| 3,765,360 | 10/1973 | Monfort | 52/309.16 X |
| 4,050,915 | 9/1977 | Brown | 65/1 |
| 4,312,162 | 1/1982 | Medney | 52/309.16 |
| 4,331,723 | 5/1982 | Hamm | 52/309.16 X |

*Primary Examiner*—Donald G. Kelly
*Assistant Examiner*—Richard E. Chilcot, Jr.
*Attorney, Agent, or Firm*—Zarley, McKee, Thomte, Voorhees & Sease

[57] ABSTRACT

A captive column structure comprising a plurality of spaced-apart elongated column portions having a plurality of spaced-apart compression core members interconnecting the same. The compression core members may take either the shape of flat sheets, hollow tubes, solid tubes or square tubes. The column portions and the compression core members may be constructed of a variety of different materials.

5 Claims, 12 Drawing Figures

CAPTIVE COLUMN

BACKGROUND OF THE INVENTION

This is a continuation-in-part application of the application, Ser. No. 519,980 filed Aug. 3, 1983, U.S. Pat. No. 4,539,785.

This invention relates to a captive column and more particularly to an improved captive column.

The concept of a captive column structure is well described in U.S. Pat. No. 3,501,880, which issued to Lawrence Bosch. In U.S. Pat. No. 3,501,880, there is disclosed a captive column structure which is comprised of a plurality of thin elongated columns having a compression core between the columns which is in engagement with each of the columns. A tension skin is wound around the columns and the core so they cannot buckle or move in any direction relative to each other.

The resulting structure disclosed by Bosch is extremely lightweight and strong. However, it has been found that it is extremely difficult to join the core elements to the column elements. Further, it has been found that the core and column elements are not waterproof and lack durability to some degree inasmuch as the components are normally comprised of wood. The construction or fabrication of the Bosch captive column is quite tedious and is expensive.

In an effort to improve the captive column structure described in U.S. Pat. No. 3,501,880, applicant provided in the co-pending application a captive column structure wherein the columns were integrally formed with a compression core and wherein the structure was comprised of a bonded fibrous material. The invention of the co-pending application represented a significant improvement of the prior art but it has been found that it is desirable to reduce the overall weight of the structure.

Therefore, it is a principal object of the invention to provide an improved captive column wherein the compression core is comprised of a plurality of spaced-apart members.

A further object of the invention is to provide a captive column structure which is formed from injection molding, pultrusion processes, extrusion processes, machine processes, stamped processes, etc. to achieve the various shapes and sizes of the structure.

These and other objects will be apparent to those skilled in the art.

SUMMARY OF THE INVENTION

Figure 1:
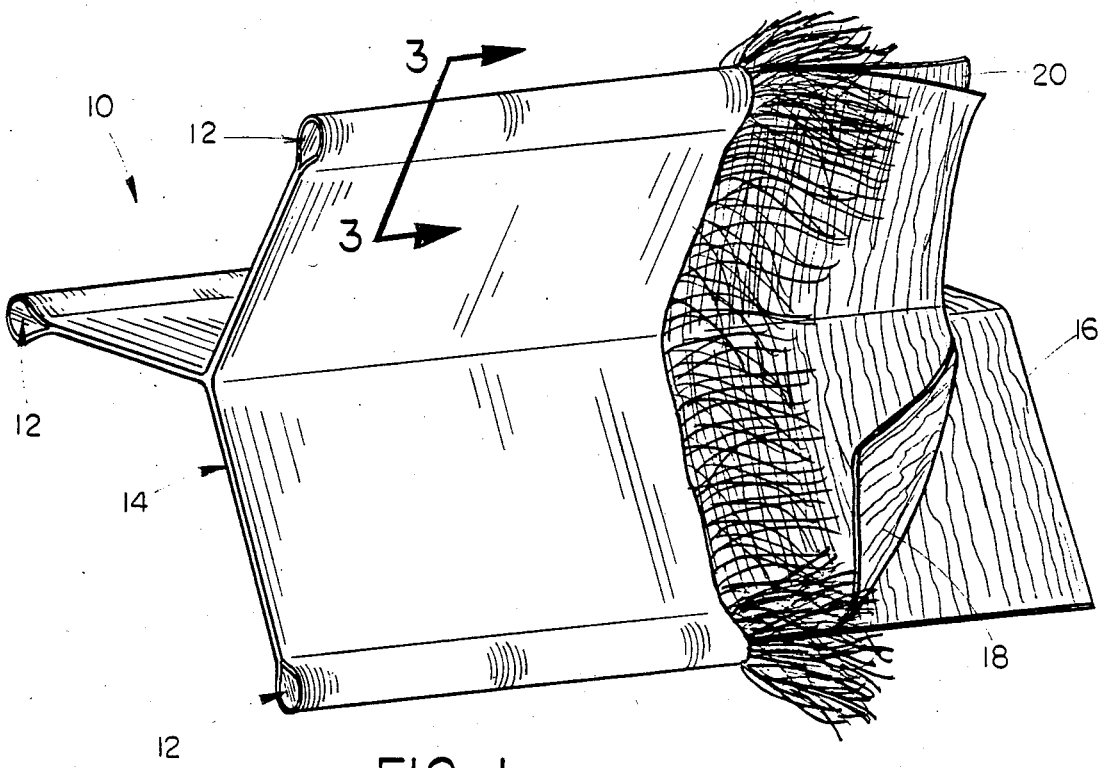
FIG. 1 is a partial perspective view of the captive column of this invention with portions thereof cut away to more fully illustrate the invention.

The captive column structure of this invention is comprised of fibrous material, steel, aluminum, plastic, wood, carbon, etc. The structure comprises a plurality of spaced-apart elongated column portions having a plurality of compression core members interconnecting the column portions. The compression core members may be formed of flat sheets, solid tubes, hollow tubes or square tubes. The columns may be formed from solid tubes, hollow tubes, square tubes, etc.

DESCRIPTION OF THE PREFERRED EMBODIMENT

The captive column structure of this invention is referred to generally by the reference numeral 10 and includes a plurality of spaced-apart column elements 12 interconnected by a plurality of spaced-apart compression core members 14. Although the drawing show the structure to be comprised of three columns 12, it should be understood that the structure could take practically any shape.

Figure 2:
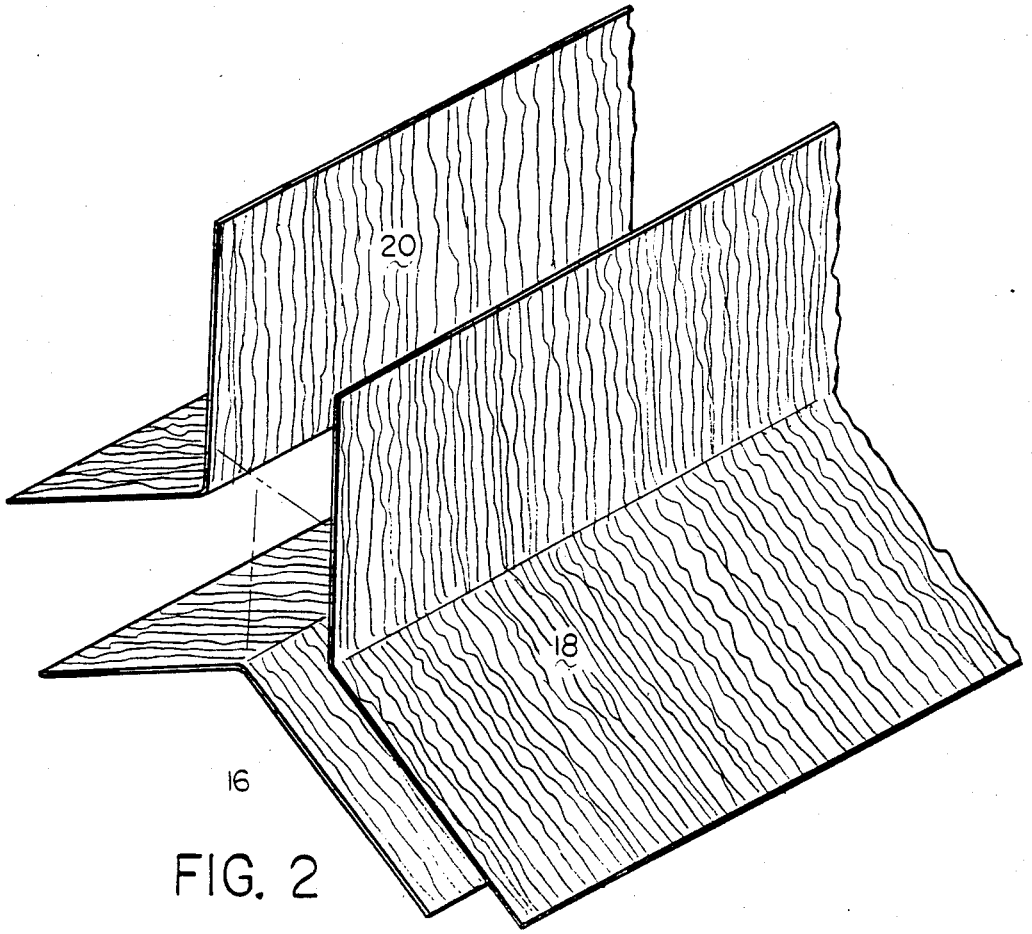
FIG. 2 is a perspective view illustrating one form of the construction of the compression core.
Figure 3:
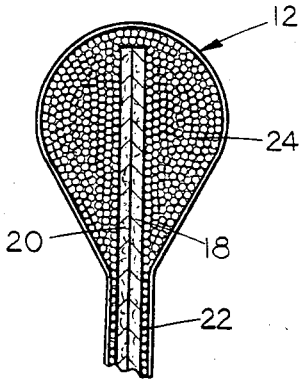
FIG. 3 is an enlarged sectional view seen on lines 3—3 of FIG. 1.

The numerals 16, 18 and 20 refer to "batts" comprised of a fibrous material such as glass fibers as will be described in more detail hereinafter. As seen in the drawings, the fibers in the batts 16, 18 and 20 are arranged so that they are disposed substantially transversely to the longitudinal axis of the column. The batts 16, 18 and 20 are positioned relative to each other as seen in FIG. 2. As best seen in FIG. 3, the ends of adjacent batts extend into the column 12. As also seen in FIGS. 1 and 3, longitudinally extending fibers 22 are positioned on the outer surfaces of the batts 16, 18 and 20. Columns 12 are comprised of continuous, longitudinally extending fibers 24 as illustrated in FIG. 3.

Figure 4:
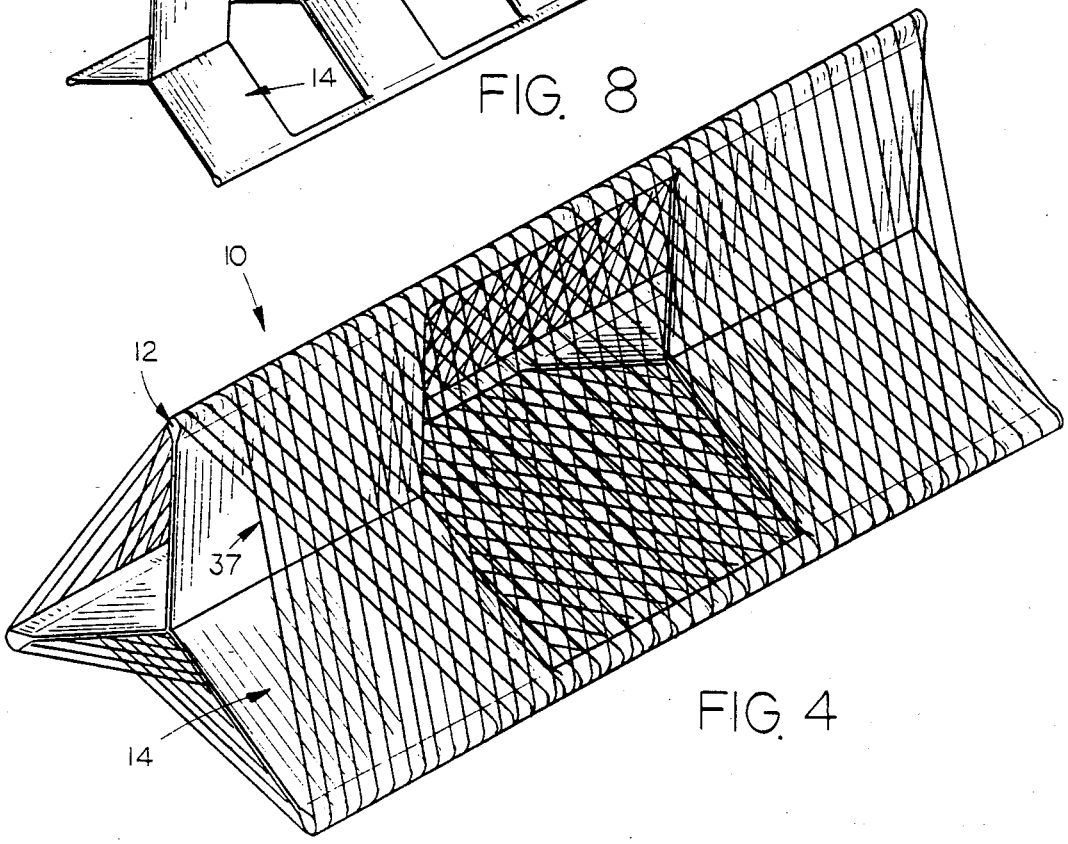
FIG. 4 is a perspective view illustrating one form of the captive column structure of this invention wound with a helical winding.
Figure 5:
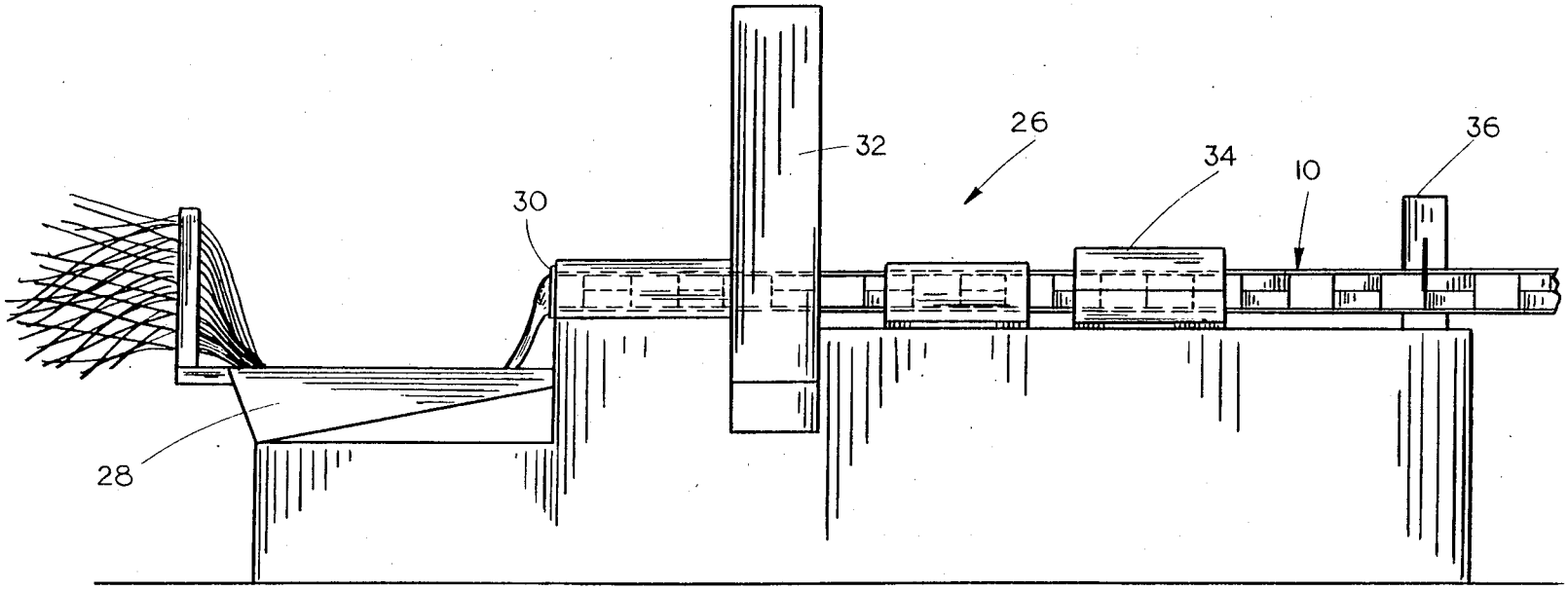
FIG. 5 is a schematic view of one type of machine used to form the captive column structure of this invention.

The structure 10 may be formed by a pultrusion machine, not forming a part of this invention, which is illustrated in schematic form in FIG. 5 and generally referred to by the reference numeral 26. The fibers or rovings are fed into the intake end of the machine at the left side of FIG. 1 and are bathed in an epoxy resin bath 28. Any suitable type of epoxy resin material may be used to bond the fibers together. The bathed fibers are then introduced into a die 30 to form the desired configuration of the column. The numeral 32 refers to the curing area of the machine 26 where the parts are cured by radio frequency, not oil, etc. The numeral 34 refers to the puller assembly which pulls the fibers through the bath 28, die 30 and curing area 32. A saw 36 is provided at the discharge end of the machine 26 for sawing the column 10 to the proper length. The column 10 is then wound in the helical fashion illustrated in FIG. 4 and as described in U.S. Pat. No. 3,501,880. The helical winding is referred to by the reference numeral 37.

It can be seen in FIG. 3 that the bathing of the fibers in the resin bath and then curing the same results in any unitary structure so that the column elements are positively interconnected to the compression core. The structure of the captive column is such that the column elements cannot buckle or move relative to one another and an extremely durable but yet lightweight structure is provided.

Figure 6:
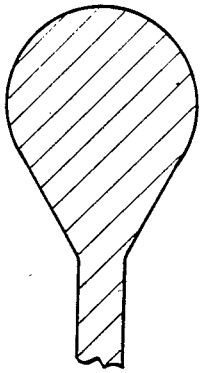
FIG. 6 is a sectional view similar to FIG. 4 illustrating the column and compression core being constructed of a metal material.
Figure 7:
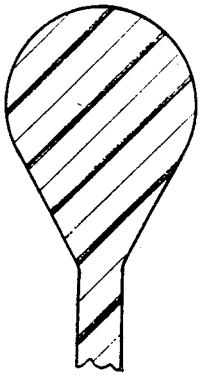
FIG. 7 is a view similar to FIGS. 3 and 6 except that the column and compression core is comprised of a thermoplastic material.
Figure 8:
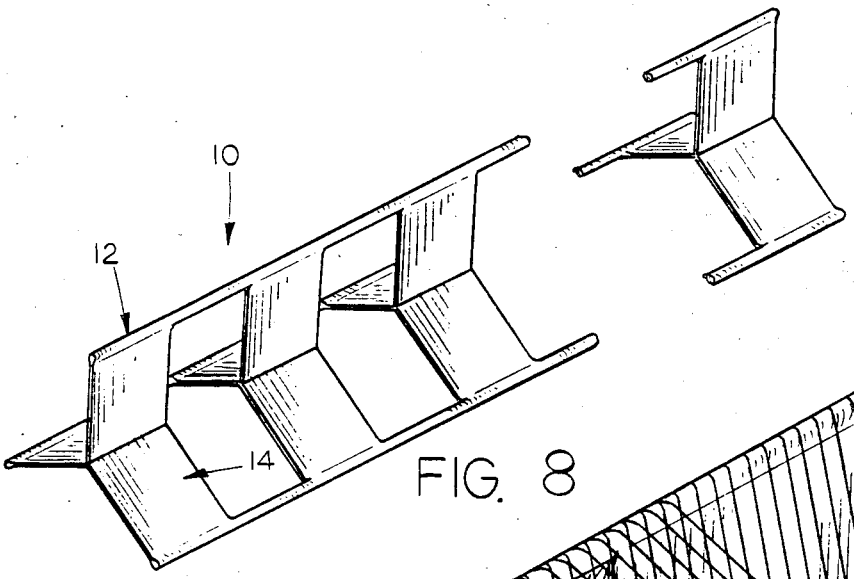
FIG. 8 is a partial perspective view of one form of the captive column structure of this invention without the helical winding thereon.
Figure 9:
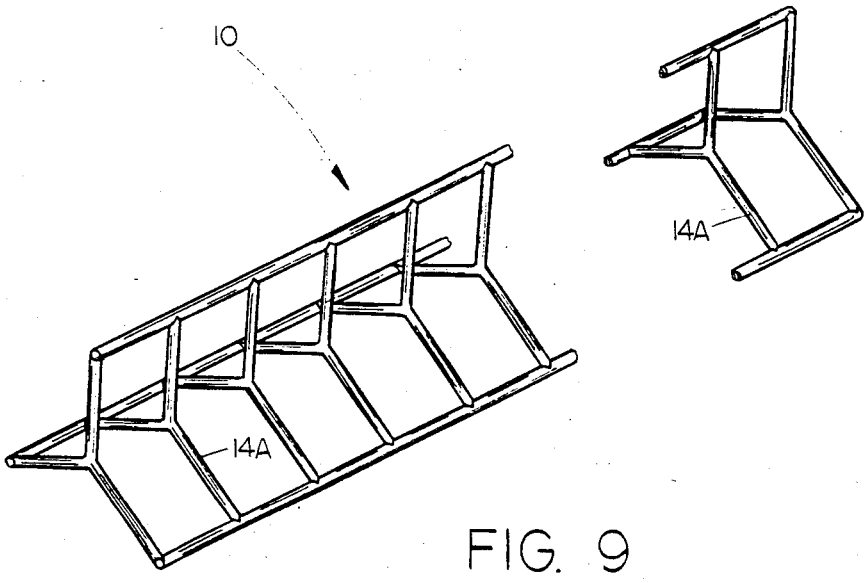
FIG. 9 is a partial perspective view of a modified form of the invention without the helical winding thereon.
Figure 10:
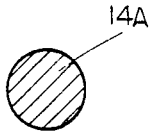
FIG. 10 is a sectional view illustrating one configuration of the compression core and column.
Figure 11:
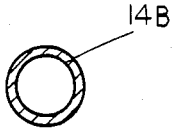
FIG. 11 is a sectional view similar to FIG. 10 except that a modified configuration of the column and compression core is illustrated.
Figure 12:
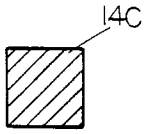
FIG. 12 is a sectional view illustrating still another configuration of the compression core and column.

FIG. 8 illustrates a captive column structure which is substantially identical to that described in the co-pending application except that the compression core members 14 as seen to be spaced from one another. The spacing of the compression core members 14 rather than having the compression core as a unitary member substantially reduces the weight of the overall structure. Although the structure illustrated in FIG. 8 is the preferred embodiment, it should be noted that the structure could also taken the configuration illustrated in FIG. 9. In FIG. 9, the compression core members 14*a* are comprised of solid tubular members rather than the sheets of material. The structure illustrated in FIG. 9 further reduces the weight of the overall structure. The compression core members could also be constructed from hollow tubular members 14*b* as illustrated in FIG. 11 or the square tubular members 14*c* illustrated in FIG. 12. The captive column structure of this invention could be comprised of metal such as illustrated in FIG. 6 or a thermoplastic material as illustrated in FIG. 7. The captive column structure illustrated and disclosed hereinto may be formed by stamping, injection molding, protrusion process, extrusion process, etc.

Thus it can be seen that the captive column of this invention accomplishes at least all of its stated objectives.

I claim:

1. An elongated captive column structure comprising, a plurality of transversely spaced-apart elongated column portions, a plurality of longitudinally spaced-apart compression core members interconnecting said column portions along the lengths thereof, and oppositely wound helical winding extending around the columns.

2. The captive column structure of claim 1 wherein the compression core members are comprised of spaced-apart flat sheet members.

3. The captive column structure of claim 1 wherein the compression core members are comprised of tubular members.

4. The captive column structure of claim 3 wherein the tubular members are hollow.

5. The captive column structure of claim 1 wherein the compression core members are comprised of square tubes.

* * * * *